US009703255B2

(12) United States Patent
Murashima

(10) Patent No.: US 9,703,255 B2
(45) Date of Patent: Jul. 11, 2017

(54) IMAGE FORMING APPARATUS

(71) Applicant: KYOCERA Document Solutions Inc., Osaka (JP)

(72) Inventor: Masaki Murashima, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 15/219,480

(22) Filed: Jul. 26, 2016

(65) Prior Publication Data

US 2017/0031305 A1 Feb. 2, 2017

(30) Foreign Application Priority Data

Jul. 30, 2015 (JP) ..... 2015-151256

(51) Int. Cl.
*G03G 15/00* (2006.01)
*G03G 21/16* (2006.01)
*B65H 1/00* (2006.01)

(52) U.S. Cl.
CPC ..... *G03G 21/1652* (2013.01); *B65H 1/00* (2013.01); *G03G 15/6502* (2013.01); *G03G 21/1604* (2013.01); *G03G 15/80* (2013.01)

(58) Field of Classification Search
CPC ..... G03G 15/6502; G03G 21/1652
See application file for complete search history.

(56) References Cited

FOREIGN PATENT DOCUMENTS

| | | | |
|---|---|---|---|
| JP | 2008-195527 A | | 8/2008 |
| JP | 2009220973 A | * | 10/2009 |
| JP | 2011255970 A | * | 12/2011 |
| JP | 2012-246076 A | | 12/2012 |

OTHER PUBLICATIONS

Araishi (JP 2009-220973 A), Oct. 2009, JPO Computer Translation.*
Kameda et al. (JP 2011-255970 A), Nov. 2011, JPO Computer Translation.*

* cited by examiner

*Primary Examiner* — Erika J Villaluna
(74) *Attorney, Agent, or Firm* — IP Business Solutions, LLC

(57) ABSTRACT

An image forming apparatus includes: an apparatus main body and a paper feed unit. The paper feed unit is detachably fitted to the apparatus main body. The paper feed unit has: a first spring being pressed against and thereby brought into contact with a plate at a bottom surface of the apparatus main body when the paper feed unit is fitted to the apparatus main body; a holding section holding the first spring; and a second spring being stretched in a state such as to be extended between the first spring and a plate at a bottom surface of the paper feed unit, and the plate of the apparatus main body and the plate of the paper feed unit are connected together through the first spring and the second spring.

5 Claims, 12 Drawing Sheets

IMAGE FORMING APPARATUS

INCORPORATION BY REFERENCE

This application claims priority to Japanese Patent Application No. 2015-151256 filed on Jul. 30, 2015, the entire contents of which are incorporated by reference herein.

BACKGROUND

This disclosure relates to an image forming apparatus such as a copier, a printer, a facsimile, or a multifunction peripheral, and more specifically to a technology for grounding a unit detachably fitted to a main body of the image forming apparatus.

The image forming apparatus is composed of various components and units in combination, and some of these components and units are required to be connected to a grounding portion of a main body of the image forming apparatus.

For example, in the image forming apparatus, a paper feed cassette loading and storing recording paper is provided, and from this paper feed cassette, the recording paper is withdrawn and then supplied, and an image is formed on this recording paper. In such an image forming apparatus, grounding is provided for removing unnecessary electrical charges. For example, such unnecessary electrical charges are generated in a main body of the apparatus. Moreover, upon the supply of the recording paper, between the withdrawn paper and the recording paper left on the paper feed cassette, friction is generated which causes, on the recording paper, electrical charges, which flow from the recording paper to the paper feed cassette. If these electrical charges are accumulated in the paper feed cassette and then discharged, noise is generated, which has an influence on an image forming process and deteriorates image quality. Thus, the paper feed cassette is connected to a grounding portion of the main body of the image forming apparatus to make the electrical charges in the paper feed cassette flow to the grounding portion of the main body.

Moreover, suggested is a conductive mechanism which includes: a coil spring pushing up a paper loading board of the paper feed cassette; a coil spring having an extended part connected to the aforementioned coil spring; a lock board, etc. and which makes electrical charges in the paper loading board flow to a paper feed section frame on a main body side of the image forming apparatus via the coil spring, the extended part, the coil spring, and the lock board.

Further, there is a conductive mechanism which has a grounding spring provided at a bottom surface of the paper feed cassette and which, with the paper feed cassette inserted and set in a housing of the main body of a printer, makes the grounding spring in contact with a metallic plate in the housing of the main body to make electrical charges in the paper feed cassette flow to the plate in the housing of the main body via the grounding spring.

SUMMARY

As one aspect this disclosure, a technology obtained by further improving the technology described above will be suggested.

An image forming apparatus according to one aspect of this disclosure includes: a main body and a unit.

The unit is detachably fitted to the main body. The unit has: a first spring being pressed against and thereby brought into contact with a conductive part of the main body when the unit is fitted to the main body; a holding section holding the first spring; and a second spring being stretched in a state such as to be extended between the first spring and a conductive part of the unit. The conductive part of the main body and the conductive part of the unit are electrically connected together through the first spring and the second spring.

DETAILED DESCRIPTION

Figure 1:
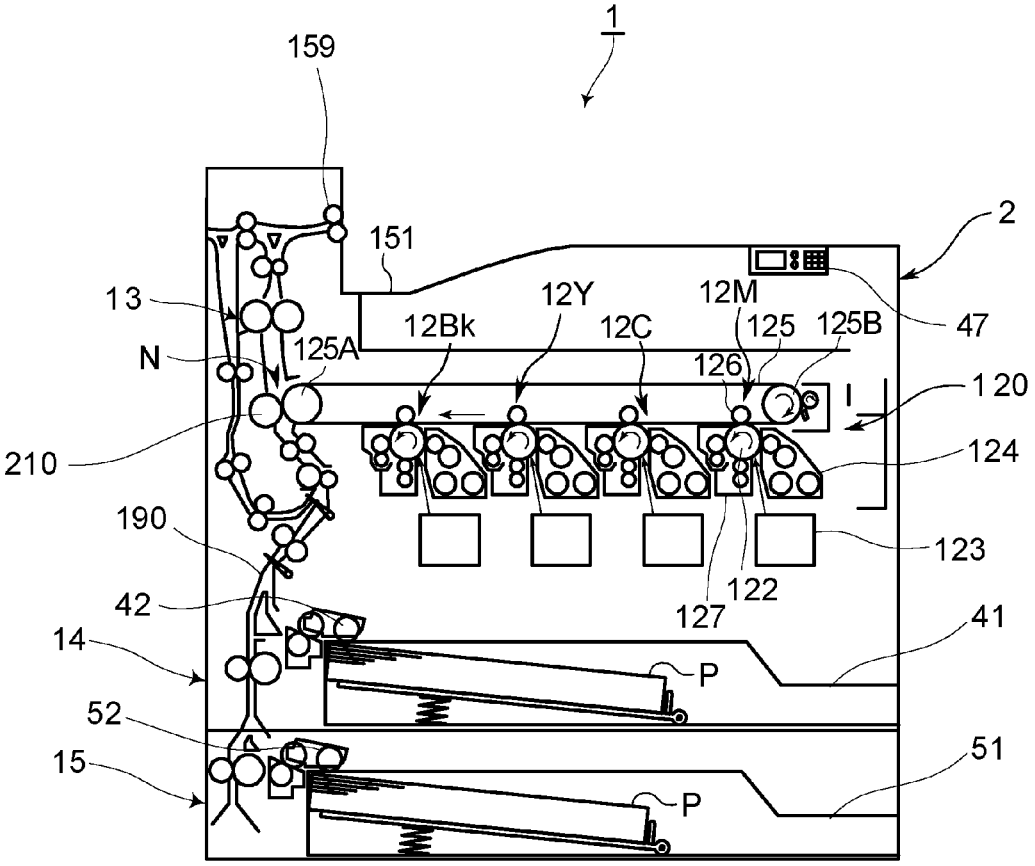
FIG. 1 is an elevational cross section showing a structure of an image forming apparatus according to one embodiment of this disclosure.
Figure 2:
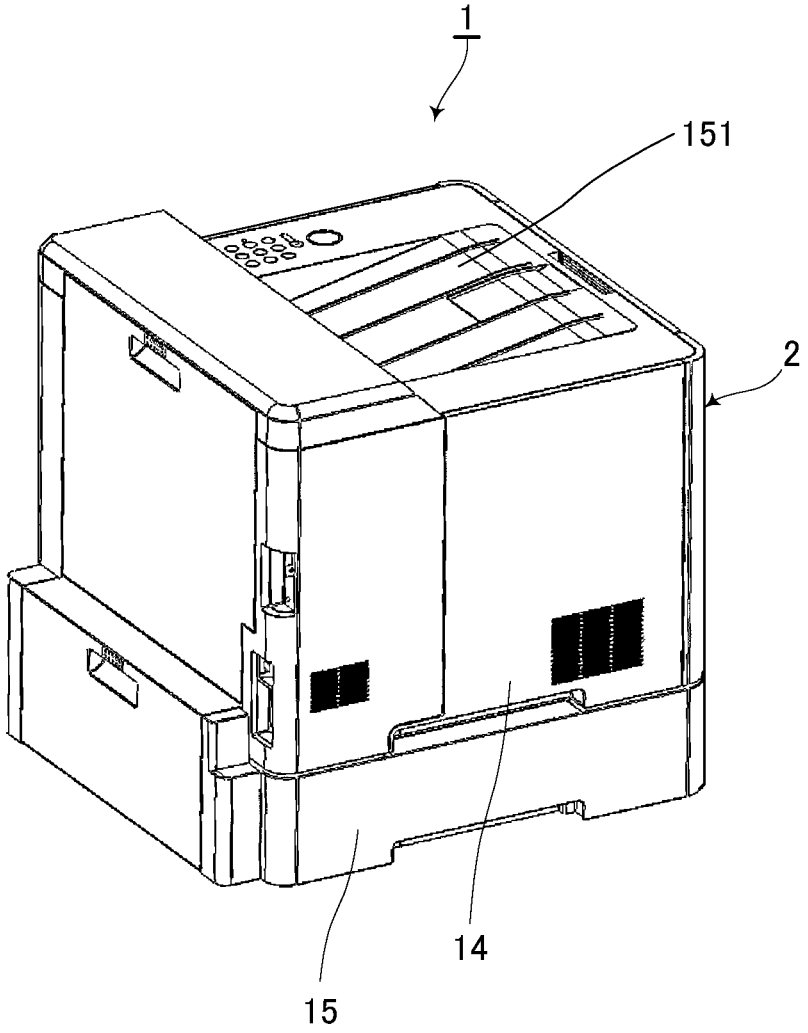
FIG. 2 is a perspective view of the image forming apparatus as seen from one side surface.
Figure 3:
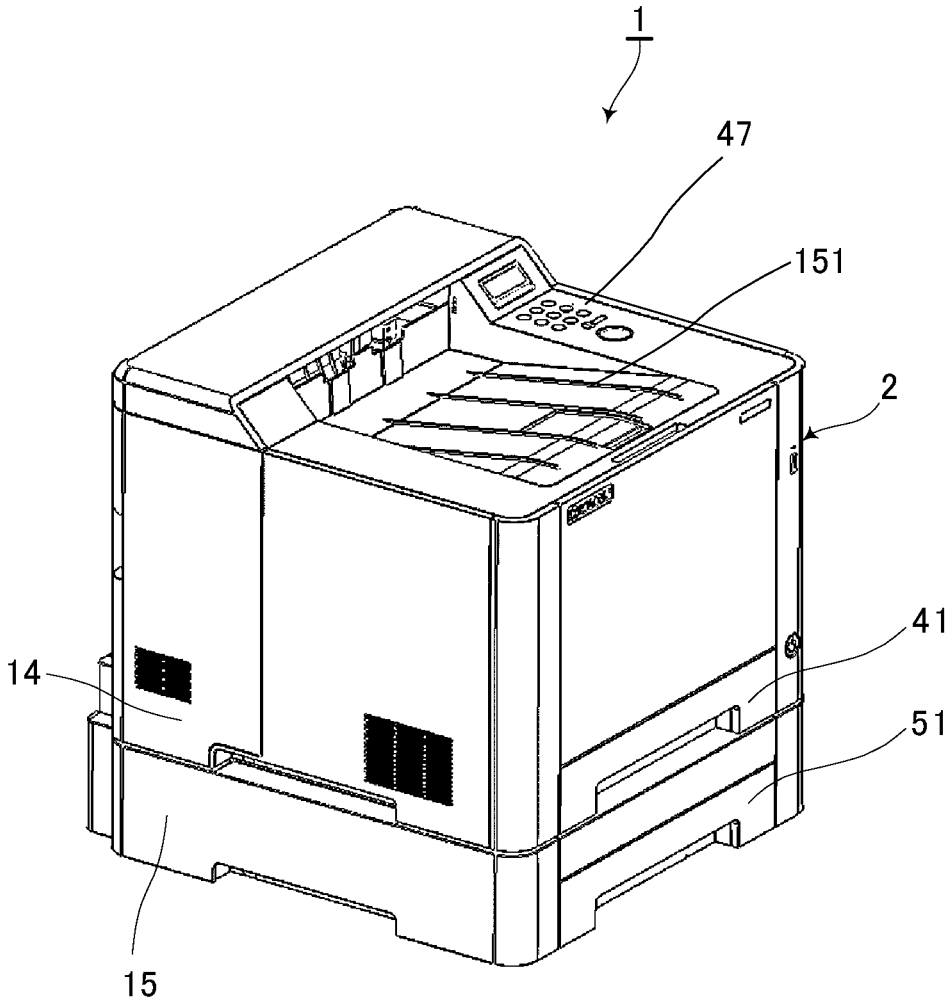
FIG. 3 is perspective view of the image forming apparatus as seen from another side surface.

FIG. 1 is an elevational cross section showing a structure of an image forming apparatus according to one embodiment of this disclosure. FIG. 2 is a perspective view of the image forming apparatus as seen from one side surface, and FIG. 3 is a perspective view of the image forming apparatus as seen from another side surface.

This image forming apparatus 1 includes: an apparatus main body 2, an operation section 47, an image formation section 120, a fixing section 13, a paper feed section 14, and a data communication section (not shown), a paper feed unit 15, etc.

The operation section 47 accepts instructions such as an image formation operation execution instruction from an operator, and also includes a display section displaying, for example, an operation guide to the operator.

The data communication section receives image data from an external terminal such as a personal computer via the network. This received image data is saved into, for example, a built-in HDD (not shown).

The image formation section 120 reads the image data from the HDD, and based on this image data, forms a toner image on recording paper P supplied from the paper feed section 14.

Image formation units 12M, 12C, 12Y, and 12Bk of the image formation section 120 each include: a photoconductive drum 122; a charging device 127 evenly charging a surface of the photoconductive drum 122; an exposure device (laser scanning unit (LSU)) 123 forming an electrostatic latent image on the surface of the photoconductive drum 122; a developing device 124 developing the electrostatic latent image on the surface of the photoconductive drum 122 into a toner image by use of a toner; and a primary transfer roller 126.

To perform color printing, in the magenta image formation unit 12M, the cyan image formation unit 12C, the yellow image formation unit 12Y, and the black image formation unit 12Bk, the surface of the photoconductive drum 122 is evenly charged and exposed to form, on this surface, an electrostatic latent image corresponding to an image of a color component, the electrostatic latent image on the surface of the photoconductive drum 122 is developed by the developing device 124 to form a toner image of this color component on the photoconductive drum 122, and the toner image is primarily transferred onto an intermediate transfer belt 125 stretched around a driving roller 125A and a driven roller 125B by the primary transfer roller 126.

The intermediate transfer belt 125 has, on its outer circumferential surface, an image-carrying surface on which a toner image is transferred, and is driven by the driving roller 125A while abutting a circumferential surface of the photoconductive drum 122. The intermediate transfer belt 125, synchronously with each photoconductive drum 122, endlessly runs between the driving roller 125A and the driven roller 125B.

The toner images of the respective color components transferred onto the intermediate transfer belt 125 are superposed on each other on the intermediate transfer belt 125 through transfer timing adjustment, turning into a color toner image. A secondary transfer roller 210, at a nip part N formed with the intermediate transfer belt 125, secondarily transfers the color toner image, which has been formed on the surface of the intermediate transfer belt 125, to the recording paper P conveyed from the paper feed section 14 through a conveyance path 190.

Then the recording paper P is heated and pressurized at the fixing section 13, the toner image on the recording paper P is fixed through thermal compression, and the recording paper P is further discharged to a discharge tray 151 through a discharge roller pair 159.

The paper feed section 14 is provided at the apparatus main body 2 of the image forming apparatus 1. This paper feed section 14 includes: a paper feed cassette 41 storing a plurality of pieces of recording paper P; and a pickup roller 42, and withdraws the recording paper P from the paper feed cassette 41 by the pickup roller 42 and conveys and supplies it to the conveyance path 190.

The paper feed unit 15 is optionally fitted to the apparatus main body 2 of the image forming apparatus 1 in a manner such as to be detachable therefrom. This paper feed unit 15, as is the case with the paper feed section 14, includes: a paper feed cassette 51 storing a plurality of pieces of recording paper P; and a pickup roller 52, and withdraws the recording paper P from the paper feed cassette 51 by the pickup roller 52 and conveys and supplies it to the conveyance path 190.

When either of the paper feed cassettes 41 and 51 has been specified through operation of the operation section 47, the pickup roller of the specified paper feed cassette is driven into rotation, and the recording paper P on this paper feed cassette is conveyed to the conveyance path 190.

In the paper feed section 14 and the paper feed unit 15, upon the supply of the recording paper P, between the withdrawn recording paper P and the recording paper P left on the paper feed cassette, friction is generated, which generates electrical charges on the recording paper P and these electrical charges flow to the paper feed cassette. If these electrical charges have been cumulated in the paper feed cassette and discharged, noise is generated, which has an influence on an image formation process and deteriorates images quality.

Thus, for both of the paper feed section 14 and the paper feed unit 15, an electrically conductive path for flowing the electrical charges from the paper feed cassette to a grounding portion of the apparatus main body 2 of the image forming apparatus 1 is formed to prevent the accumulation and discharge of the electrical charges.

Here, for the paper feed section 14, the paper feed cassette 41 is provided in the apparatus main body 2, thus making it easy to ensure the electrically conductive path from the paper feed cassette 41 to the grounding portion of the apparatus main body 2.

On the contrary, to form the electrically conductive path from the paper feed cassette 51 of the paper feed unit 15 to the grounding portion of the apparatus main body 2, since the paper feed unit 15 is optionally fitted to the apparatus main body 2 in a manner such as to be detachable therefrom, it is required to enable electrical connection and separation between the paper feed unit 15 and the apparatus main body 2 and also make connection between a plate of a bottom surface of the paper feed unit 15 and a plate of a bottom surface of the apparatus main body 2, that is, between the mutually separated plates.

Thus, in this embodiment, to form the electrically conducting path from the paper feed cassette 51 of the paper feed unit 15 to the grounding portion of the apparatus main body 2, the paper feed unit 15 is formed in a manner described below.

Figure 4:
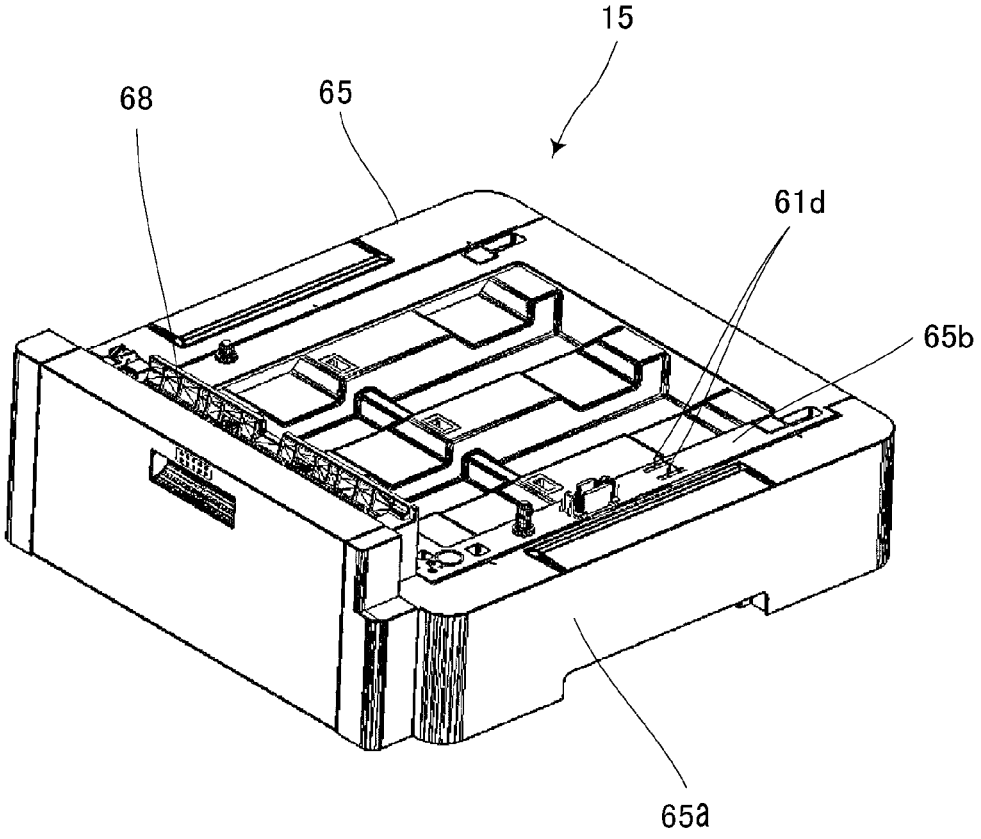
FIG. 4 is a perspective view of a paper feed unit as seen from one side surface.
Figure 5:
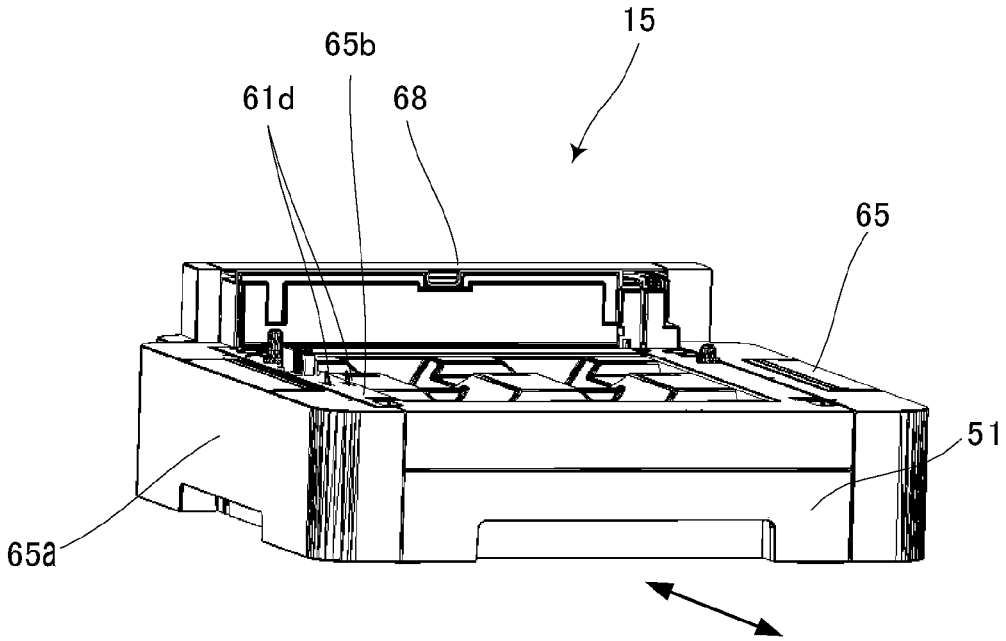
FIG. 5 is a perspective view of the paper feed unit as seen from another side surface.

FIG. 4 is a perspective view of the paper feed unit 15 as seen from one side surface, and FIG. 5 is a perspective view of the paper feed unit 15 as seen from another side surface. As shown in FIGS. 4 and 5, the paper feed unit 15 includes: a housing 65; and the paper feed cassette 51 arranged inside of the housing 65. The paper feed cassette 51 is provided in a manner such as to be insertable and withdrawable in a direction of arrow, and with the paper feed cassette 51 withdrawn, the recording paper P is refilled in the paper feed cassette 51.

On this paper feed unit 15, the apparatus main body 2 of the image forming apparatus 1 is loaded, whereby the paper feed unit 15 is fitted to the apparatus main body 2. On a top surface of the paper feed unit 15 and the bottom surface of the apparatus main body 2, a plurality of pairs of concavities and convexities which engage with each other are provided, so that the engagement between the concavity and the convexity in each pair positions the paper feed unit 15 with respect to the apparatus main body 2. In this state, the recording paper P is withdrawn from the paper feed cassette 51 and delivered to the conveyance path 190 (shown in FIG. 1) of the apparatus main body 2 through a discharge port 68 provided at a top end part of the housing 65.

Figure 6:
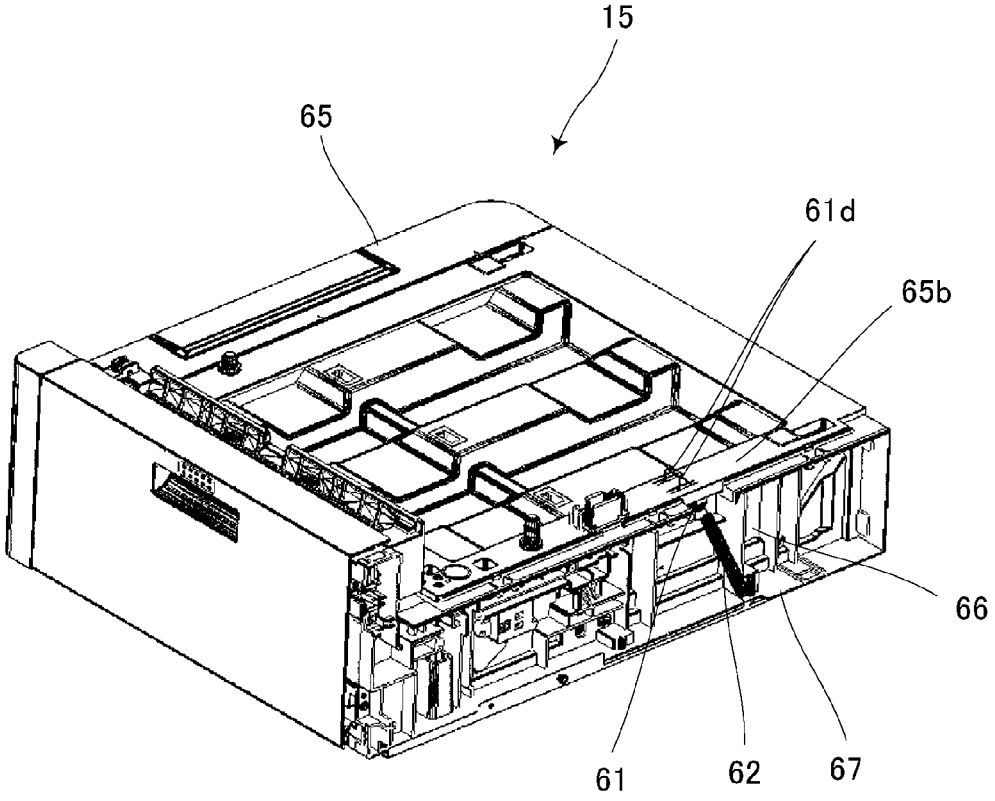
FIG. 6 is a perspective view showing a state in which a first spring, a second spring, etc. are exposed with a side wall cover of the paper feed unit removed.
Figure 7A:
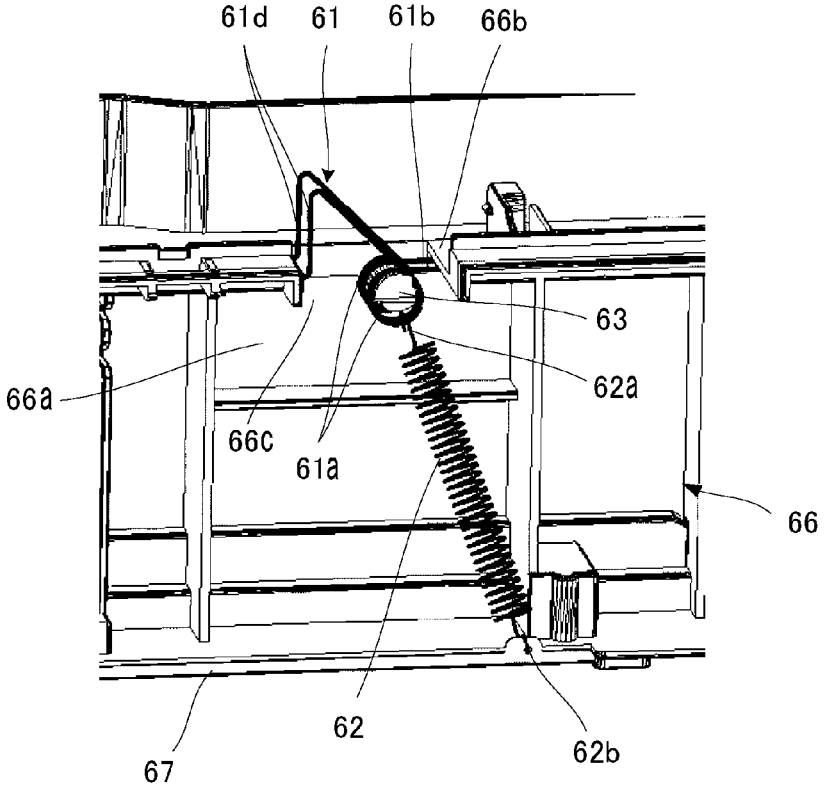
FIG. 7A is a perspective view of the first spring, the second spring, and a holding section as seen from a side.
Figure 7B:
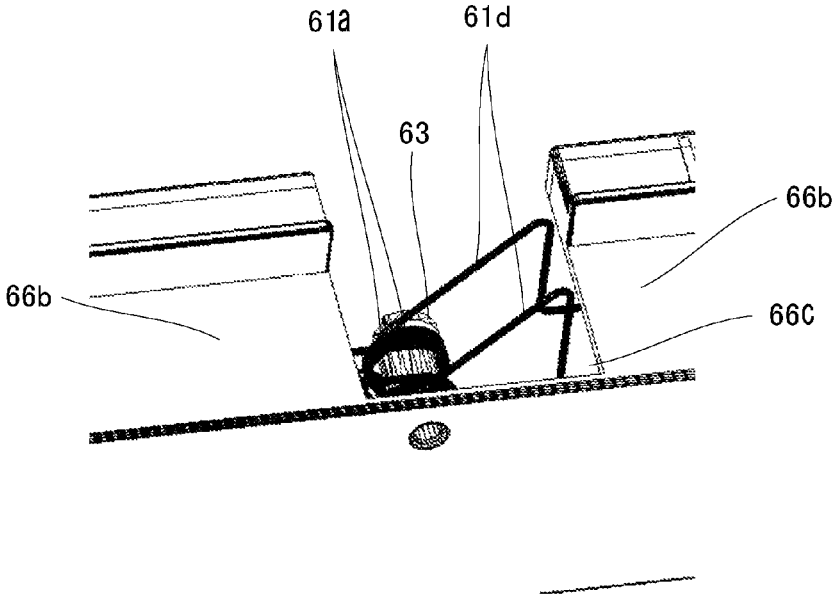
FIG. 7B is a perspective view of the first spring, the second spring, and the holding section as seen from a top.
Figure 8:
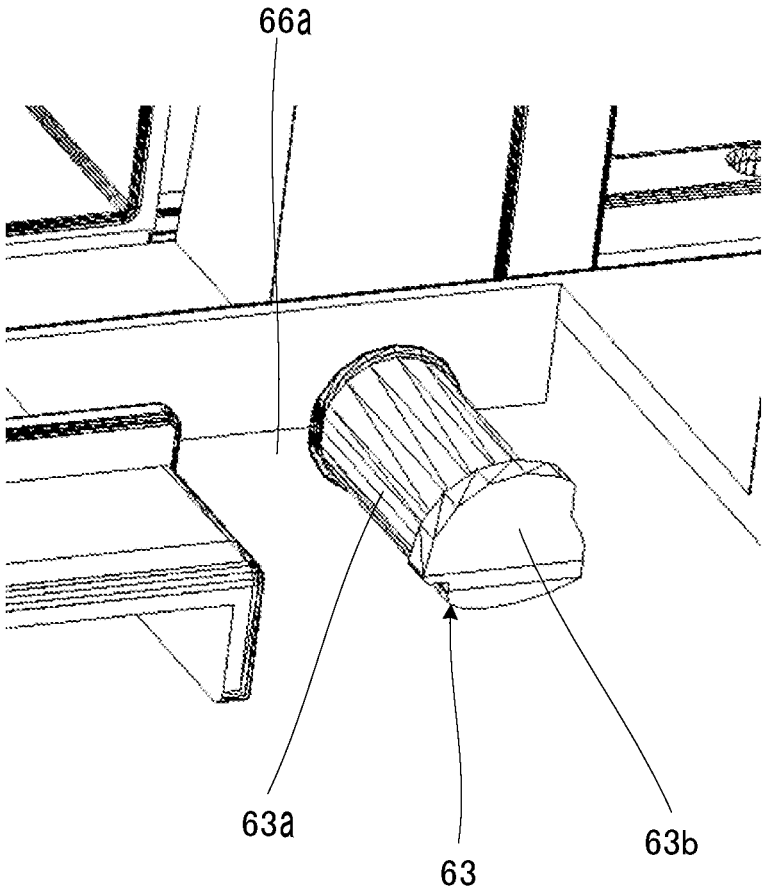
FIG. 8 is a perspective view showing the holding section.
Figure 9:
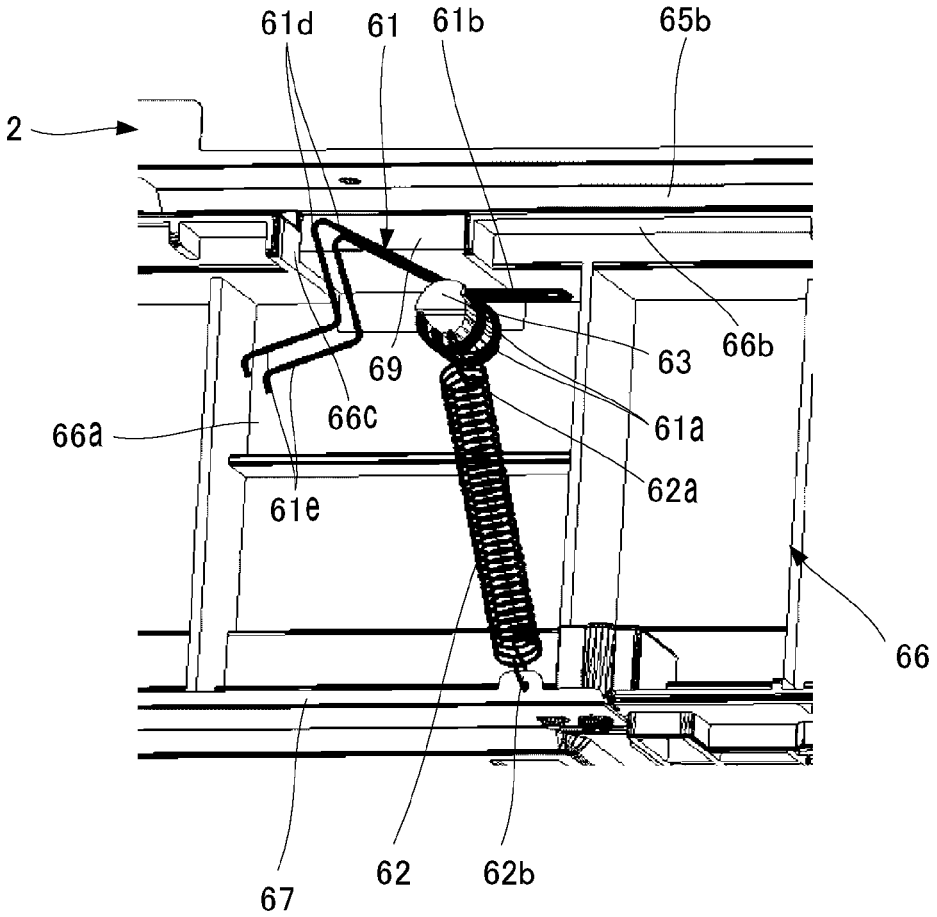
FIG. 9 is a perspective view of a state of the first spring as seen from a side when an apparatus main body is loaded on the paper feed unit.

FIG. 6 is a perspective view showing a state in which a first spring 61 and a second spring 62 as part of the electrically conducting path described above are exposed with a side wall cover 65*a* of the paper feed unit 15 removed. FIG. 7A is a perspective view of the first spring 61, the second spring 62, and s holding section 63 as seen from a side, and FIG. 7B is a perspective view of the first spring 61, the second spring 62, and the holding section 63 as seen from a top. Further, FIG. 8 is a perspective view showing the holding section 63 with the first spring 61 and the second spring 62 removed, and FIG. 9 is a perspective view showing a state of the first spring 61 as seen from a side when the apparatus main body 2 is loaded on the paper feed unit 15.

As shown in FIGS. 6 through 9, the first spring 61 is a so-called torsional spring, and has: two coil spring parts 61*a* of a ring-like shape; two engaging arms 61*b* outwardly and linearly extending from the respective coil spring parts 61*a;* two bending arms 61*d* which are extended from the respective coil spring parts 61*a* almost oppositely to the respective engaging arms 61*b* and which are bent in a V-shape; and engaging parts 61*e* extended in a manner such as to be bent at tips of the respective bending arms 61*d*.

The holding section 63 is integrally formed with a frame 66 of synthetic resin of the paper feed unit 15, and has: a shaft part 63*a* projected horizontally to a side wall 66*a* of this frame 66 (a side part of the paper feed unit 15); and a flanged convex part 63*b* provided at a tip of the shaft part 63*a*.

Here, to an inside of each coil spring part 61*a* of the first spring 61, the shaft part 63*a* and the flanged convex part 63*b* of the holding section 63 are inserted, so that each coil spring part 61*a* of the first spring 61 is supported by the shaft part 63*a* of the holding section 63. In this state, the flanged convex part 63*b* is projected from the shaft part 63*a* with respect to the first spring 61 supported by the shaft part 63*a*, at a position opposite to a direction of the side wall 66*a* of the paper feed unit 15 on a basic end side of the shaft part 63*a*, in a direction opposite to a direction in which the first spring 61 is pressed by the plate 69 when the apparatus main body 2 is loaded on the paper feed unit 15.

As a result, in the first spring 61 being supported by the shaft part 63*a* of the holding section 63, movement of this coil spring part 61*a* to a tip side of the shaft part 63*a* is regulated at the shaft part 63*a*, making it difficult for the coil spring part 61*a* to be detached from the shaft part 63*a*.

At a side edge board 66*b* of the frame 66 of the paper feed unit 15, a notched part 66*c* is formed, and the engaging arm 61*b* of the first spring 61 is locked at a lower surface of one of the side edge boards 66*b* divided into two by the notched part 66*c*, and the engaging part 61*e* at the tip of each bending arm 61*d* of the first spring 61 is locked at a lower surface of another one of the aforementioned side edge boards 66*b* divided into two.

Therefore, each coil spring part 61*a* of the first spring 61 is supported by the shaft part 63*a* of the holding section 63, and each engaging arm 61*b* of the first spring 61 and the engaging part 61*e* at the tip of each bending arm 61*d* are respectively locked at the lower surfaces of the two side edge boards 66*b* divided by the notched part 66*c*. As a result, the first spring 61 is held.

Each bending arm 61*d* of the first spring 61 is projected upwardly from the frame 66 through the notched part 66*c* of the side edge board 66*b*. As shown in FIG. 6, in a state in which an upper side cover 65*b* is attached to the frame 66, each bending arm 61*d* of the first spring 61 is projected upwardly via each slit of the upper side cover 65*b*.

The second spring 62 is a so-called coil spring, and has hooks 62*a* and 62*b* at top and bottom ends. While this second spring 62 is extended, the hook 62*a* at the top end is hooked at each coil spring part 61*a* of the first spring 61, and the hook 62*b* at the bottom end is hooked at an engagement hole of a metallic plate 67 fixed at a bottom surface of the frame 66.

As a result of loading the apparatus main body 2 of the image forming apparatus 1 on such a paper feed unit 15 whereby the paper feed unit 15 is fitted to the apparatus main body 2, as shown in FIG. 9, a metallic plate 69 fixed at the bottom surface of the apparatus main body 2 is superposed on the upper side cover 65*b* of the paper feed unit 15. At this point, the plate 69 of the apparatus main body 2 pushes up each bending arm 61*d* of the first spring 61 projected upwardly via each slit of the upper side cover 65*b*. Then by elastic force of the first spring 61, each bending arm 61*d* of this first spring 61 is brought into pressure contact with the plate 69 of the apparatus main body 2 and conducted.

While the second spring 62 is extended, the hooks 62*a* and 62*b* of the second spring 62 are respectively hooked in engagement holes of each coil spring part 61*a* of the first spring 61 and the plate 67 of the paper feed unit 15, and thus the first spring 61, the second spring 62, and the plate 67 are conducted.

Thus, simultaneously with the loading of the apparatus main body 2 of the image forming apparatus 1 on the paper feed unit 15, the plate 67 of the paper feed unit 15 is connected to the plate 69 of the apparatus main body 2 through the first spring 61 and the second spring 62.

Further, in the apparatus main body 2, the plate 69 is previously and electrically connected to the grounding portion of the apparatus main body 2. For example, through one code or wire, or connection between metal members, the plate 69 is connected to the grounding portion. Thus, the pate 67 of the paper feed unit 15 is also connected to the grounding portion of the apparatus main body 2 through the first spring 61, the second spring 62, and the plate 69 of the apparatus main body 2.

As described above, the second spring 62 is extended between the first spring 61 and the plate 67 of the paper feed unit 15 to connect together the first spring 61 and the plate 67 of the paper feed unit 15. Then the first spring 61 is pressed against the plate 69 of the apparatus main body 2 when the paper feed unit 15 is fitted to the apparatus main body 2, and is conducted through its contact with this plate 69, and is connected to the aforementioned grounding portion of the apparatus main body 2. This connects the plate 67 of the paper feed unit 15 to the grounding portion of the apparatus main body 2.

Note that the plate 67 of the paper feed unit 15 is one example of a conductive part of a unit in a scope of claims, and the plate 69 of the apparatus main body 2 is one example of a conductive part of a main body in the scope of the claims.

Next, configuration of the connection between the paper feed cassette 51 and the plate 67 in the paper feed unit 15 will be described, clarifying the electrically conducting path from the paper feed cassette 51 to the grounding portion of the apparatus main body 2.

Figure 10:
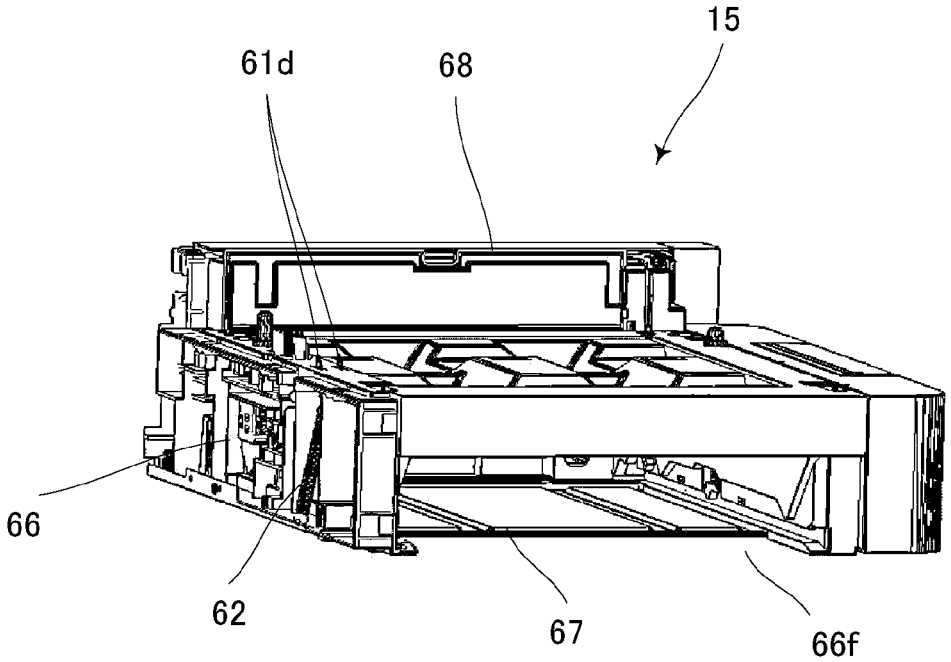
FIG. 10 is a perspective view showing an inside of the paper feed unit with a paper feed cassette withdrawn from the paper feed unit.
Figure 11:
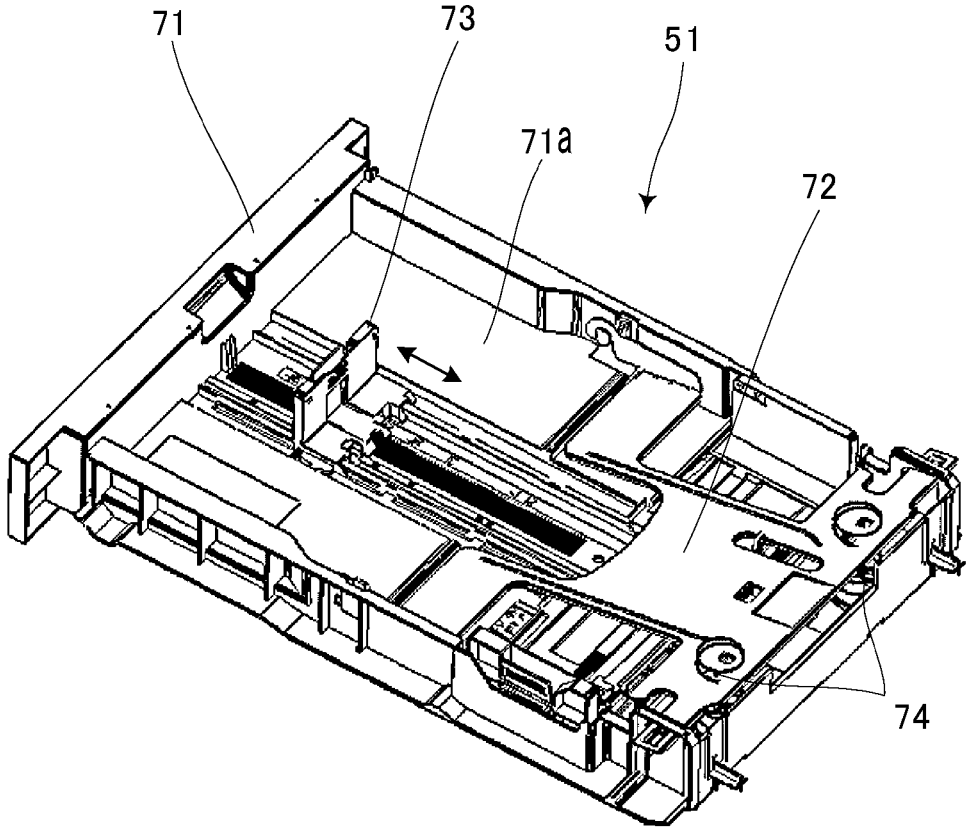
FIG. 11 is a perspective view showing the paper feed cassette.
Figure 12:
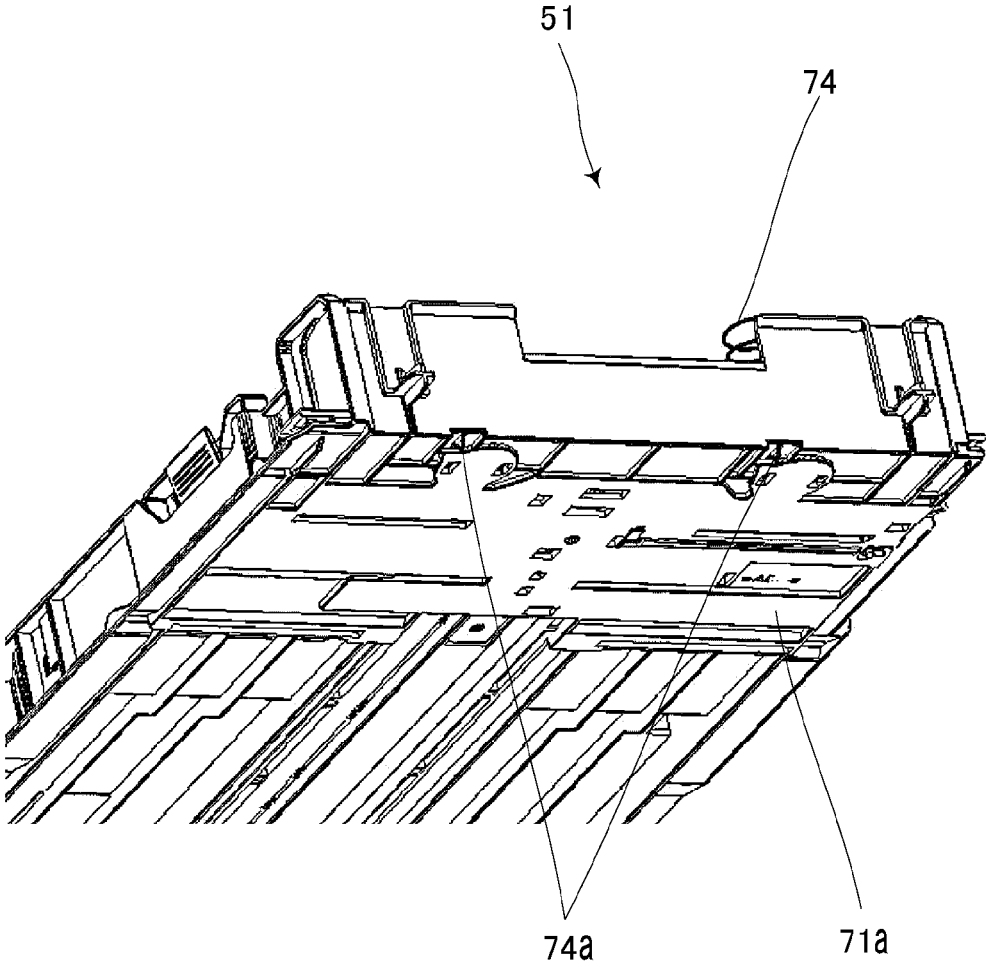
FIG. 12 is a perspective view of a tip side of the paper feed cassette inserted further inside of the paper feed unit as seen from a bottom.

FIG. 10 is a perspective view showing an inside of the paper feed unit 15 with the paper feed cassette 51 pulled out of the paper feed unit 15. FIG. 11 is a perspective view showing the paper feed cassette 51. FIG. 12 is a perspective view of a tip side of the paper feed cassette 51 inserted further inside of the paper feed unit 15 as seen from a bottom.

At the bottom surface of the frame 66 of the paper feed unit 15, the plate 67 is fixed as shown in FIG. 10. The paper feed cassette 51 is inserted in an opening part 66*f* of the frame 66 and set while loaded on the plate 67.

As shown in FIG. 11, the paper feed cassette 51 has: a cassette body 71, a loading board 72 of metal provided at a bottom part 71*a* of the cassette body 71; an abutting board 73 projected at the bottom part 71*a* in a manner such as to be movable in a direction of arrow; two coil springs 74 pushing up a tip end side of the loading board 72.

On the loading board 72, the plurality of pieces of recording paper P (shown in FIG. 1) are loaded, and back ends of the pieces of recording paper P are brought to abut the abutting board 73 and thereby aligned. Moreover, a back end part of the loading board 72 is rotationally pivoted at a side wall of the cassette body 71, and a tip side of the loading board 72 is pushed upwardly by each coil spring 74, whereby the loading board 72 is inclined and the recording paper P at an uppermost layer on the loading board 72 is brought to abut the pickup roller 52 (shown in FIG. 1). In this state, when the pickup roller 52 is driven into rotation, the recording paper P at the uppermost layer is withdrawn by the pickup roller 52, and this recording paper P is delivered to the conveyance path 190 (shown in FIG. 1) of the apparatus main body 2 through the discharge port 68 (shown in FIGS. 4 and 5) of the housing 65 of the paper feed unit 15.

Here, as shown in FIG. 12, a lower end part 74*a* of each coil spring 74 is projected downwardly from the bottom part 71*a* of the cassette body 71. Thus, inserting and setting the paper feed cassette 51 in the opening part 66*f* of the frame 66 of the paper feed unit 15 and loading the paper feed cassette 51 on the plate 67 of the paper feed unit 15 brings the lower end part 74*a* of each coil spring 74 to make contact with the plate 67 and turn into a conducting state.

Further, the metallic loading board 72 of the paper feed cassette 51 is in contact with an upper end part of each coil spring 74.

Thus, in a state in which the paper feed cassette 51 is set in the paper feed unit 15, the loading board 72 of the paper feed cassette 51 is connected to the plate 67 of the paper feed unit 15 through each coil spring 74.

Then as described above, the plate 67 of the paper feed unit 15 is connected to the grounding portion of the apparatus main body 2, thus forming the electrically conducting path from the loading board 72 of the paper feed unit 15 to the grounding portion of the apparatus main body 2.

Thus, upon supply of the recording paper P, even when electrical charges are generated on the recording paper P and flow to the paper feed cassette 51, these electrical charges flow from the paper feed cassette 51 to the grounding portion of the apparatus main body 2, and thus no electrical charges are cumulated in the paper feed cassette 51.

On the other hand, in this embodiment, appropriately setting a shape and an outer diameter of the flanged convex part 63*b* of the holding section 63 as shown in FIG. 8 makes it easy to perform operation of attaching the first spring 61 and also prevents detachment of the first spring 61.

The flanged convex part 63*b* of the holding section 63 is formed in a manner such as to be projected only upwardly from the shaft part 63*a* and not projected downwardly from the shaft part 63*a*. Then the outer diameter of the flanged convex part 63*b* of the holding section 63 is kept smaller than an inner diameter of each coil spring part 61*a* of the first spring 61. This makes it possible to easily insert the shaft part 63*a* and the flanged convex part 63*b* of the holding section 63 inside of the coil spring part 61*a* of the first spring 61.

Moreover, as a result of pressing each bending arm 61*d* of the first spring 61 downwardly by the plate 69 of the apparatus main body 2, each coil spring part 61*a* is pressed against an upper side of a circumferential surface of the shaft part 63*a* of the holding section 63. Thus, even upon movement of each coil spring part 61*a* of the first spring 61 in a direction detaching from the shaft part 63*a* (in a horizontal direction), each coil spring part 61*a* hits the flanged convex part 63*b* projected upwardly from this shaft part 63*a* and is thus not detached.

Furthermore, biasing each coil spring part 61*a* of the first spring 61 substantially downwardly by the second spring 62 also presses each coil spring part 61*a* against the upper side of the circumferential surface of the shaft part 63*a* of the holding section 63. Therefore, not only each bending arm 61*d* of the first spring 61 is pressed downwardly and each coil spring part 61*a* of the first spring 61 is pressed against the upper side of the circumferential surface of the shaft part 63*a*, but also each coil spring part 61*a* is pressed against the upper side of the circumferential surface of the shaft part 63*a* by the second spring 62. Thus, a situation such that each coil spring part 61*a* goes beyond the flanged convex part 63*b* projected upwardly from the shaft part 63*a* and is thereby detached more hardly occurs.

Specifically, while the operation of attaching the first spring 61 is easy, the first spring 61 is not easily detached. According to this embodiment, it is possible to provide, with simple configuration, the electrically conducting path from the paper feed unit 15 detachably fitted to the apparatus main body 2 to the grounding portion of the apparatus main body 2.

In the embodiment described above, the plates 67 and 69 separated from each other by the first spring 61 and the second spring 62 are connected together, but another conductive part of the apparatus main body 2 and another conductive part of the paper feed unit 15, which are separated from each other, may be connected together.

Moreover, the paper feed unit 15 has been illustrated, but this disclosure is also applicable to any kind of unit which is detachably fitted to the apparatus main body 2 and which is required to be connected to the grounding portion of the apparatus main body 2.

The two conductive mechanisms shown in Background have the paper feed cassette built in the main body of the image forming apparatus, thus making it easy to ensure the electrically conducting path from the paper feed cassette to the grounding portion of the main body.

However, the paper feed unit optional to the main body of the image forming apparatus may be fitted later on, and to form the electrically conducting path from the paper feed cassette built in this paper feed unit to the grounding portion of the main body, it is required to enable the electrical connection and separation between the paper feed unit and the main body. Moreover, to form the electrically conducting path described above, in attempts to connect together the conductive part of the paper feed unit and the conductive part of the main body, these conductive parts may be separated from each other. For example, in a case where the conductive part of the main body is a plate at a bottom surface of the main body and the conductive part of the paper feed unit is a plate at a bottom surface of the paper feed unit, the both bottom surfaces are separate from each other and their plates are also separate from each other. Thus, for the paper feed unit, it is difficult to set the electrically conducting path from the paper feed cassette to the grounding portion of the main body.

Not only the paper feed unit but also any kind of unit which is detachably fitted to the main body of the image forming apparatus and which is required to be connected to the grounding portion of the main body has the same problem.

On the contrary, in the embodiment described above, it is possible to provide, with simple configuration, the electrically conducting path from the unit detachably fitted to the main body of the image forming apparatus to the grounding portion of this main body.

Moreover, in the embodiment described above, the description has been provided, referring to the color printer as the image forming apparatus according to this disclosure, but this is just one example, and it may be any other image forming apparatus such as a monochromatic printer or another electronic device, for example, a multifunction peripheral, a copier, or a facsimile device.

Moreover, the configuration and the processing described with reference to FIGS. 1 to 12 are just one embodiment of this disclosure, and it is not intended to limit this disclosure to these configuration and processing.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. An image forming apparatus comprising:

a main body; and a unit detachably fitted to the main body, wherein the unit has:

a first spring being pressed against and thereby brought into contact with a conductive part of the main body when the unit is fitted to the main body;

a holding section holding the first spring; and a second spring being stretched in a state such as to be extended between the first spring and a conductive part of the unit, the conductive part of the main body and the conductive part of the unit are electrically connected together through the first spring and the second spring, and the first spring is a torsional spring and has a coil spring part of a ring-like shape, the holding section is passed through and inside of the coil spring part of the first spring to hold the first spring, and has a shaft part and a convex part provided at a tip of the shaft part, and the shaft part of the holding section is passed through the inside of the coil spring part of the first spring whereby the coil spring part is supported by the shaft part, and the convex part is projected from, the shaft part, with respect to the first spring being supported at the shaft part, at a position opposite to a direction of a side of the unit as a base end side of the shaft part, in a direction opposite to a direction in which the first spring is pressed by the conductive part of the main body.

2. The image forming apparatus according to claim 1, wherein the conductive part of the main body is at a bottom surface of the main body and is connected to a grounding portion of the main body, and the conductive part of the unit is at a bottom surface of the unit and is separated from the bottom surface of the main body.

3. The image forming apparatus according to claim 1, wherein the second spring attracts the first spring in the direction in which the first spring is pressed by the conductive part of the main body.

4. The image forming apparatus according to claim 1, wherein the unit is a paper feed unit including a paper feed cassette, the paper feed cassette is detachable from a housing of the paper feed unit, and comprises:

a cassette body including recording paper;

a loading board of metal which is provided in the cassette body and on which the recording paper is loaded; and a conducting member being connected to the loading board and being exposed to an outside from a bottom surface of the cassette body, and in the housing of the paper feed unit, the conductive part of the paper feed unit is provided at a position below the paper feed cassette while the paper feed cassette is fitted, and the conductive member on a side of the paper feed cassette is conducted through contact with the conductive part on a side of the housing when the paper feed cassette is fitted in the housing.

5. An image forming apparatus comprising:

a main body; and a unit detachably fitted to the main body, wherein the unit has:

a first spring being pressed against and thereby brought into contact with a conductive part of the main body when the unit is fitted to the main body;

a holding section holding the first spring; and a second spring being stretched in a state such as to be extended between the first spring and a conductive part of the unit, the conductive part of the main body and the conductive part of the unit are electrically connected together through the first spring and the second spring, the unit is a paper feed unit including a paper feed cassette, the paper feed cassette is detachable from a housing of the paper feed unit, and comprises:

a cassette body including recording paper;

a loading board of metal which is provided in the cassette body and on which the recording paper is loaded; and a conducting member being connected to the loading board and being exposed to an outside from a bottom surface of the cassette body, and in the housing of the paper feed unit, the conductive part of the paper feed unit is provided at a position below the paper feed cassette while the paper feed cassette is fitted, and the conductive member on a side of the paper feed cassette is conducted through contact with the conductive part on a side of the housing when the paper feed cassette is fitted in the housing.

* * * * *